US009212842B2

(12) United States Patent
Vasbinder et al.

(10) Patent No.: US 9,212,842 B2
(45) Date of Patent: Dec. 15, 2015

(54) COOLER CARRIER

(71) Applicant: Rock-Tenn Shared Services, LLC, Norcross, GA (US)

(72) Inventors: Eric Vasbinder, Mableton, GA (US); Jeffrey Scott James, Elmhurst, IL (US); Fred Foushee, Suwanee, GA (US)

(73) Assignee: WestRock Shared Services, LLC, Norcross, GA (US)

( * ) Notice: Subject to any disclaimer, the term of this patent is extended or adjusted under 35 U.S.C. 154(b) by 0 days.

(21) Appl. No.: 14/217,554

(22) Filed: Mar. 18, 2014

(65) Prior Publication Data

US 2014/0263593 A1 Sep. 18, 2014

Related U.S. Application Data

(60) Provisional application No. 61/802,843, filed on Mar. 18, 2013.

(51) Int. Cl.

| | |
|---|---|
| ***F25D 3/08*** | (2006.01) |
| ***B65D 5/42*** | (2006.01) |
| ***B65D 5/20*** | (2006.01) |
| ***B65D 5/24*** | (2006.01) |
| ***B65D 5/40*** | (2006.01) |
| ***B65D 5/468*** | (2006.01) |
| *B65D 5/56* | (2006.01) |
| *B65D 5/60* | (2006.01) |

(52) U.S. Cl.

CPC ..... *F25D 3/08* (2013.01); *B65D 5/2042* (2013.01); *B65D 5/242* (2013.01); *B65D 5/40* (2013.01); *B65D 5/4608* (2013.01); *B65D 5/563* (2013.01); *B65D 5/60* (2013.01)

(58) Field of Classification Search

USPC ..... 229/123, 117.25, 117.23, 138; 62/464

See application file for complete search history.

(56) References Cited

U.S. PATENT DOCUMENTS

| | | | | |
|---|---|---|---|---|
| 2,457,422 | A | 12/1948 | Warner | |
| 4,305,500 | A | 12/1981 | Jaeschke | |
| 4,687,130 | A | 8/1987 | Beeler | |
| 5,020,337 | A * | 6/1991 | Krieg | 62/464 |
| 5,094,359 | A * | 3/1992 | DeMars et al. | 229/101 |
| 5,307,986 | A * | 5/1994 | Schuster | 229/186 |

(Continued)

FOREIGN PATENT DOCUMENTS

| | | |
|---|---|---|
| CA | 155666 | 11/2014 |

OTHER PUBLICATIONS

"Triangular carrying box/compose type carton packaging design", retrieved from the internet at http://www.packmage.com/BoxTemplates/Z024_Triangular-Carrying-Box.aspx, at least as early as Mar. 6, 2014, Package Technology Co., Limited, 2013, 1 page.

(Continued)

*Primary Examiner* — Christopher Demeree

(74) *Attorney, Agent, or Firm* — WestRock IP Legal

(57) ABSTRACT

Embodiments of the present invention provide a carrier that is designed to hold a plurality of beverages, such as but not limited to cans or bottles. In some embodiments, the carrier is designed to also serve as a cooler. For example, the cans or bottles may be loaded into the carrier when the top is opened. Due to the shape and/or configuration of the carrier, the carrier has ample room for not only the beverages, but also ice when in the opened position. As such, the carrier is configured to be a one-time or multi-use cooler.

18 Claims, 6 Drawing Sheets

(56) References Cited

U.S. PATENT DOCUMENTS

| | | | | |
|---|---|---|---|---|
| 5,337,947 | A | 8/1994 | Eskandry | |
| 5,490,396 | A | 2/1996 | Morris | |
| 5,558,224 | A | 9/1996 | Fogle | |
| 5,582,343 | A * | 12/1996 | Dalvey | 229/101 |
| 6,360,558 | B1 | 3/2002 | Woog | |
| 2009/0282843 | A1 | 11/2009 | Brand | |

OTHER PUBLICATIONS

U.S. Appl. No. 29/485,250, Notice of Allowance mailed on Mar. 19, 2015, 8 pages.

* cited by examiner

COOLER CARRIER

CROSS REFERENCE TO RELATED APPLICATIONS

This application claims the benefit of U.S. Provisional Application Ser. No. 61/802,843, filed Mar. 18, 2013, titled "Cooler Carrier," the entire contents of which are hereby incorporated by reference.

FIELD OF THE DISCLOSURE

Embodiments of the present disclosure relate generally to a carrier designed to hold and carry a plurality of containers. The carrier can be opened and expanded such that it provides ample room to hold not only the beverages, but to also hold ice and to serve as a cooler. This allows the carrier to be used to contain and transport beverages, and to also serve a one-time (or multi-use) cooler once the carrier has been opened and the carrying function is no longer needed.

BACKGROUND

Packaging for beverages may play a role in a consumer's purchasing choice. One example has recently been seen in the beer beverage industry. For example, bottles have been marketed with labels that indicate when the beverage is chilled, with bottle mouths having certain shapes to encourage smooth passage of the beverage from the bottle to the consumer, and with improved bottle caps, among others.

However, improvements to the actual packaging of the beverages is also desired. For example, if a particular consumer is undecided as to what type of beer to buy, but sees an attractive feature provided by the packaging of one brand of beer, the consumer may be more likely than not to purchase the beer with the attractive packaging. Additionally, consumers loyal to a particular brand may be pleased to see innovative packaging and become even more loyal. This can also be the case for packaging for sodas, juices, water, sparkling water, sports drinks, and any other kinds of beverages or other bottled or canned goods.

Beverages are typically packaged and sold in paperboard boxes that are formed as a square or rectangular-shaped box around the beverages contained therein. One end of the package may be opened and the user may remove the desired number of beverages contained therein. However, it is desirable to provide more creative packaging options.

BRIEF SUMMARY

Disclosed is a carrier that is designed to hold a plurality of beverages, such as but not limited to cans or bottles. In some embodiments, the carrier is designed to also serve as a cooler. For example, the cans or bottles may be loaded into the carrier when the top is opened. Due to the shape and/or configuration of the carrier, the carrier has ample room for not only the beverages, but also ice when in the opened position. As such, the carrier is configured to be a one-time or multi-use cooler.

DETAILED DESCRIPTION

Figure 1:
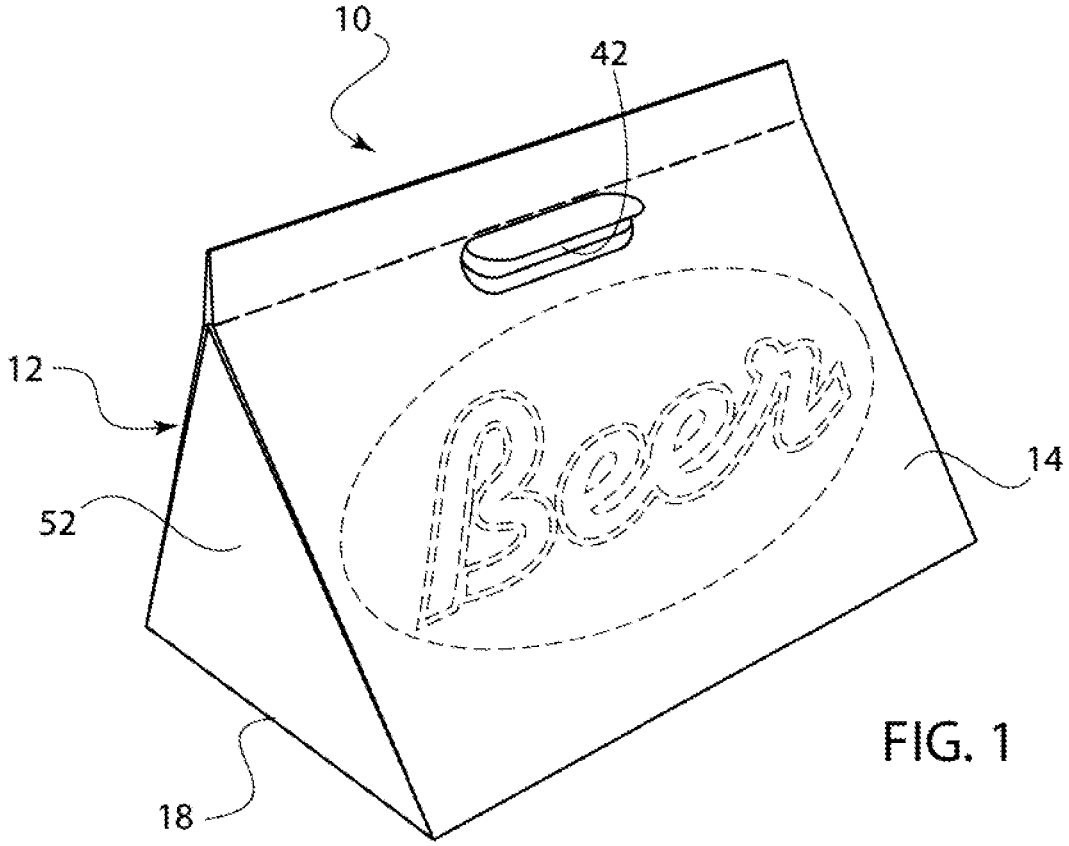
FIG. 1 shows a side perspective view of one embodiment of a carrier in a closed position.

Embodiments of the present disclosure provide an improved packaging system that results in a carrier that can be converted to a cooler upon opening. As shown in FIG. 1, in some embodiments, the carrier 10 has a generally triangular (from a side view) or pyramidal (from a perspective view) shape when in the shipping configuration shown. The carrier 10 is shown having a body portion 12 that is formed from a front wall panel 14, a back wall panel 16, and a base panel 18. The sides of the carrier 10 are formed from two gusseted side portions 20, one on either side of the carrier 10.

Figure 2:
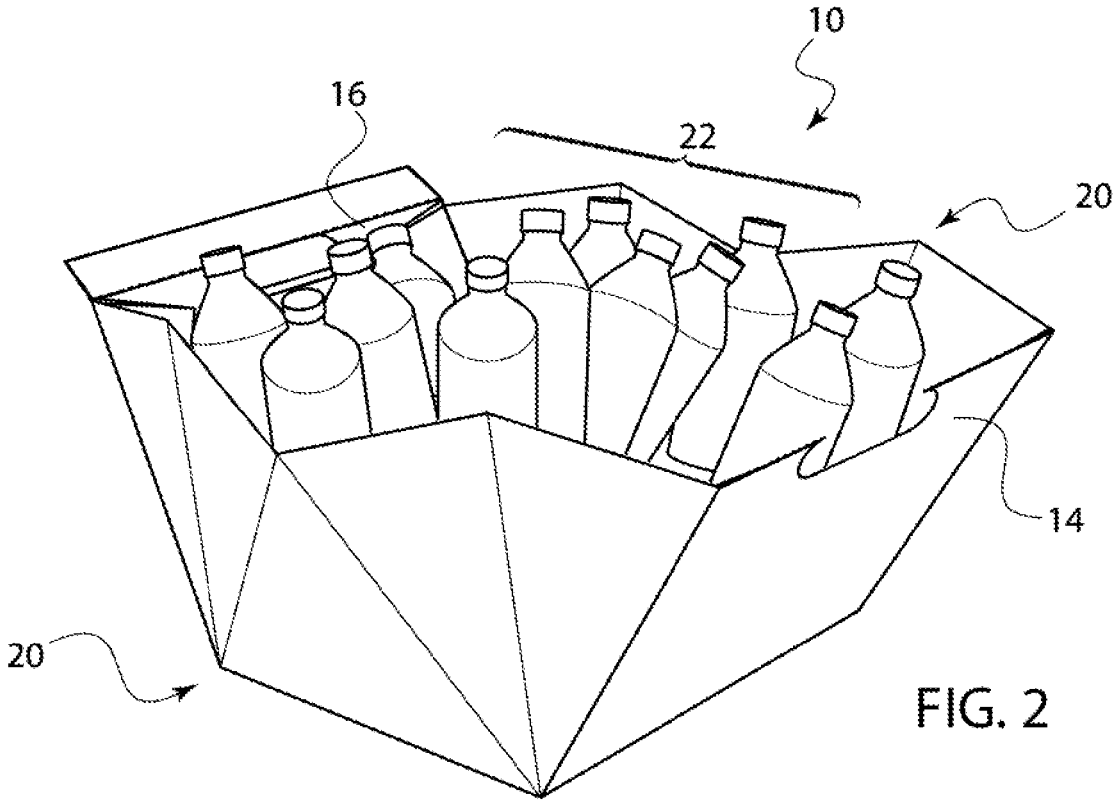
FIG. 2 shows the carrier of FIG. 1 in an opened configuration, in which ice may be added to chill the containers being contained and carried by the cooler carrier.

As shown in FIG. 2, when the carrier 10 is opened, the gusseted sides 20 of the carrier 10 open to elongate the carrier into a suitable shape with an interior 22 for storing the beverages and/or added ice.

Figure 3:
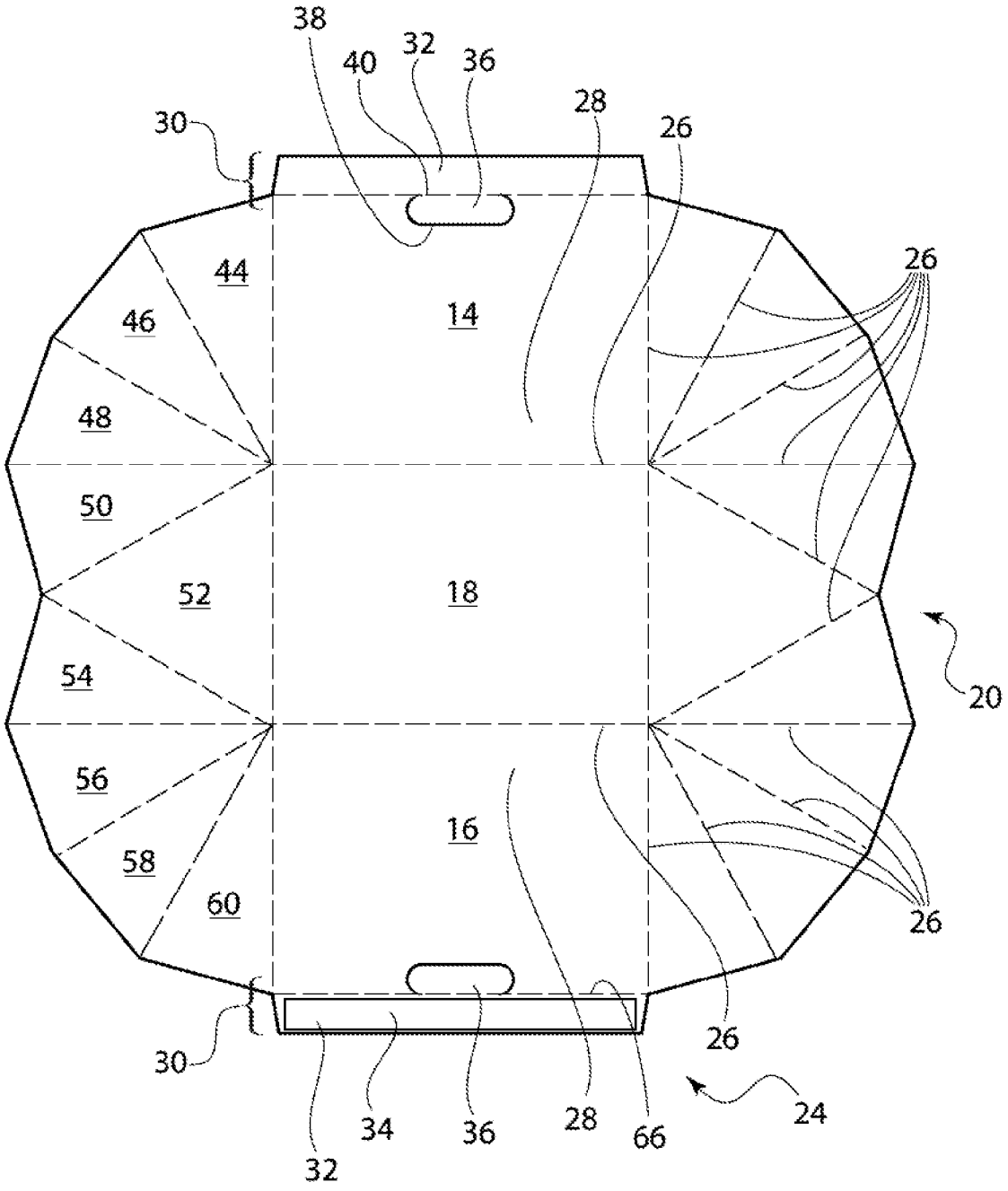
FIG. 3 shows a top plan view of one embodiment of a blank that may be used to create a cooler carrier.

One embodiment of a blank 24 that may be used to form such a carrier 10 is shown in FIG. 3. It should be understood, however, that other blank shapes and designs may be used to form a cooler carrier design that may fall within the scope of the claims. The blank 24 is shown as having a series of dotted lines, which represent either pre-creased fold lines and/or small perforations. These may be score lines, fold lines, lines of weakness, or other features that ease the folding process. In some instances, scores, which may be lines of weaknesses or area where the blank has been thinned from pressing or rolling or cutting, may be provided to keep the blank from cracking or being difficult to create a fold between panels during assembly. The material may be generally corrugated paperboard, laminated paperboard, or any other material suitable for containing and storing items in a container-like structure.

Referring now specifically to the embodiment of the blank 24 shown in FIG. 3, there is provided a front wall panel 14, a back wall panel 16, and an base panel 18 therebetween. Pre-creased fold lines 26 may be provided to divide the panels from one another and to ease erection of the carrier 10. Each of the front wall panel 14 and the back wall panel 16 may have a base-contacting edge 28 and an upper edge 30. The upper edge 30 may generally feature a securement flap 32. In a specific embodiment, one (or both) of the securement flaps may have a double-faced adhesive 34, with one face of the adhesive secured to the securement flap 32 and a removable strip on the other face that can be removed for the securement flap 32 of one panel to be secured to the securement flap 32 of another panel.

The upper edge 30 may also feature a handle-shaped opening 36 at or near the upper edge. The handle-shaped opening 36 is generally formed as a curved cut out-portion 38 and a creased fold line 40. To erect the carrier 10, the front and back wall panels 14, 16 are drawn toward one another. The curved cut out portion 38 of the handle-shaped opening 36 can be pushed away from the panels to provide a carrying opening 42 on the carrier, as shown in FIG. 1.

Referring back to FIG. 3, the blank 24 also has two side gusseted portions 20. Only one of the side gusseted portions 20 is described in detail here, but it should be understood that the other side gusseted portion 20 has like elements with like reference numerals. In a specific embodiment, the side gusseted portion 20 is formed from nine panels. When the carrier is closed, only a middle face panel 52 is viewable and the remainder of the panels are folded inwardly, out of view. When the carrier 10 is opened, one or more of the remaining panels can expand open in order to provide a carrier with increased interior space 22.

Figure 4:
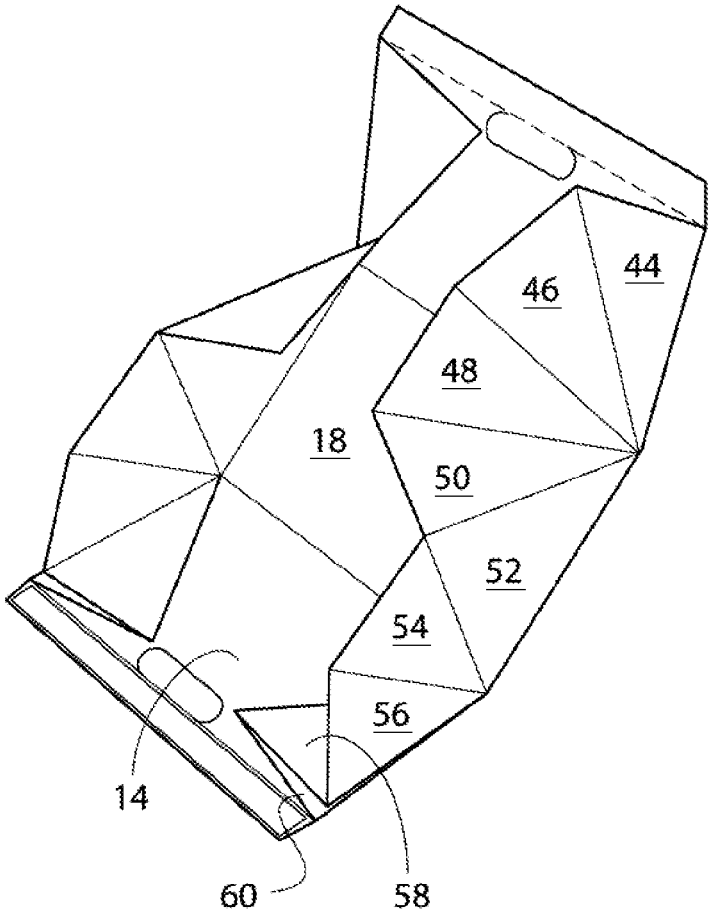
FIG. 4 shows a top perspective view of one embodiment of a cooler carrier as it is having glue flaps secured to the front and back wall panels.

In the embodiment shown, two of the left-most panels form a first and second glue flap panels 44, 46. The first glue flap panel 44 can be glued to the front wall panel 14. The second glue flap panel 46 can be glued to the first glue flap panel 44. One example of the gluing of the glue panels is illustrated by FIG. 4. It should be understood that it may be possible to design a blank 24 that does not have such glue flap panels 44, 46. This may be done by, e.g., providing the blank in more than one piece and gluing separate panels to one another. Other options are possible. However, it has been found that the embodiment described and shown can save material and time by providing a flat one-piece blank with such glue flap panels.

Figure 8:
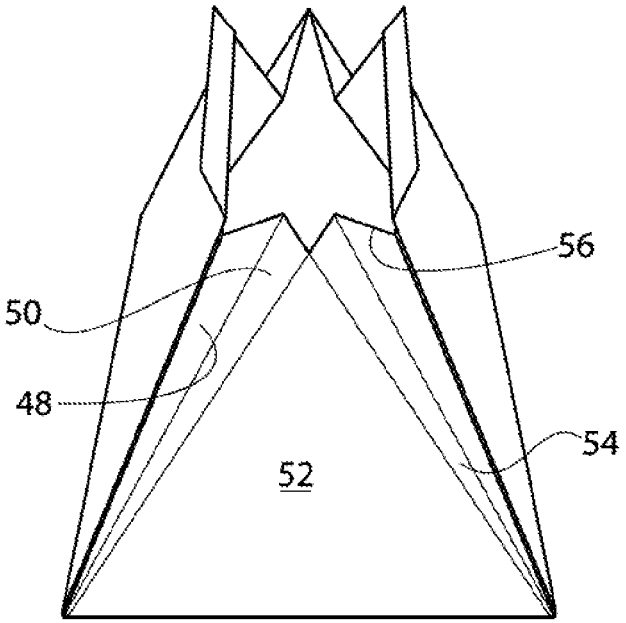
FIG. 8 shows a side perspective view of one embodiment of a cooler carrier as the inwardly foldable panels are folded inward, just prior to sealing the front and back wall panels to one another.

The next two panels on the blank 24 are inwardly foldable panels 48, 50. As shown in FIGS. 5-9, the first inwardly foldable panel 48 can folded against the second glue flap panel 46 and against the second inwardly foldable panel 50. A side view of this folding is shown in FIG. 8. The next panel is the middle panel 52. This is actually the only one of the side panels that is viewable when the carrier 10 is in its closed configuration (as shown in FIGS. 1 and 8). The remainder of the panels are folded into the carrier 10.

Figure 5:
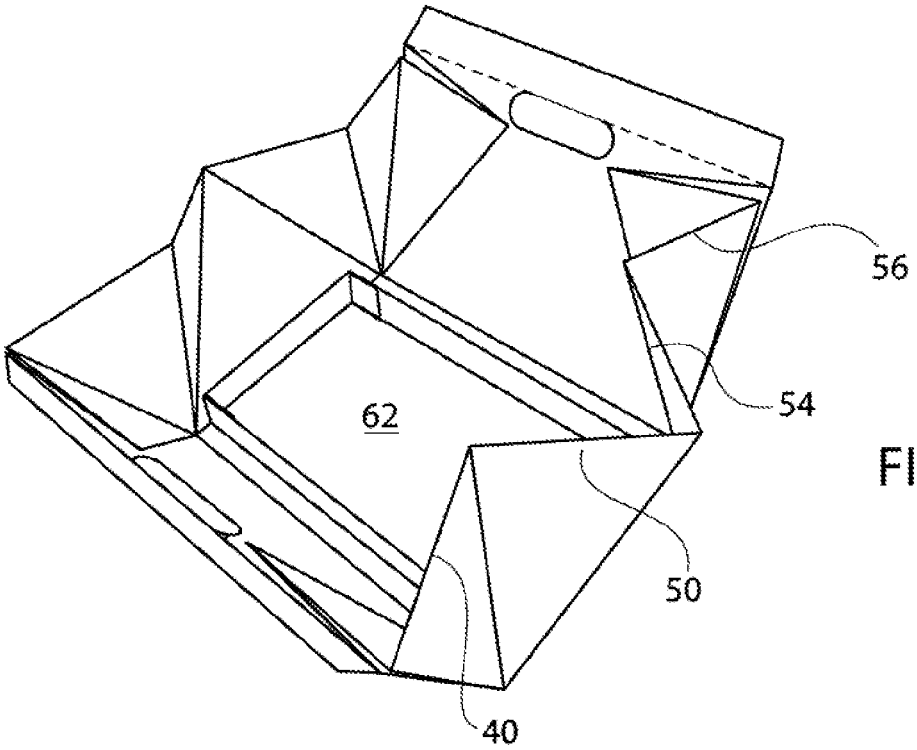
FIG. 5 shows a top perspective view of one embodiment of a cooler carrier as the inwardly foldable panels are being folded inwardly.
Figure 6:
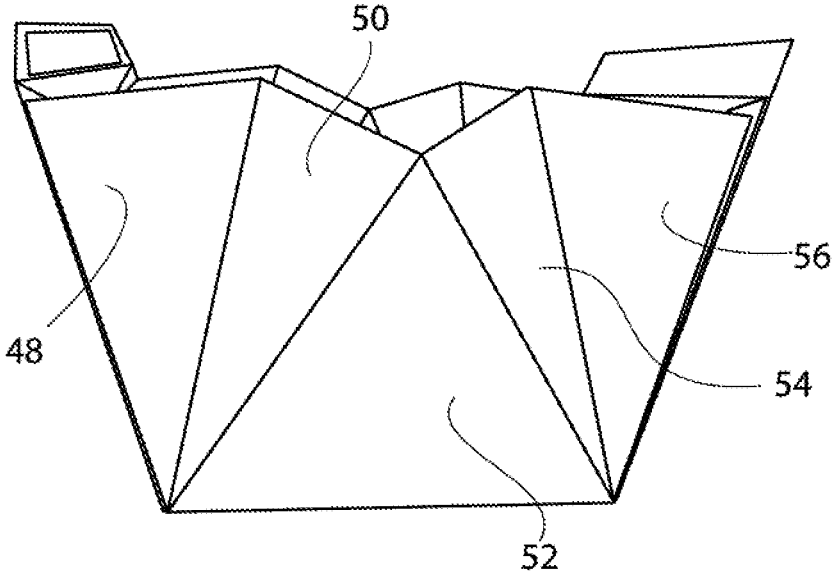
FIG. 6 shows a side perspective view of one embodiment of a cooler carrier as the inwardly foldable panels are being folded inwardly, and showing the middle face panel.
Figure 7:
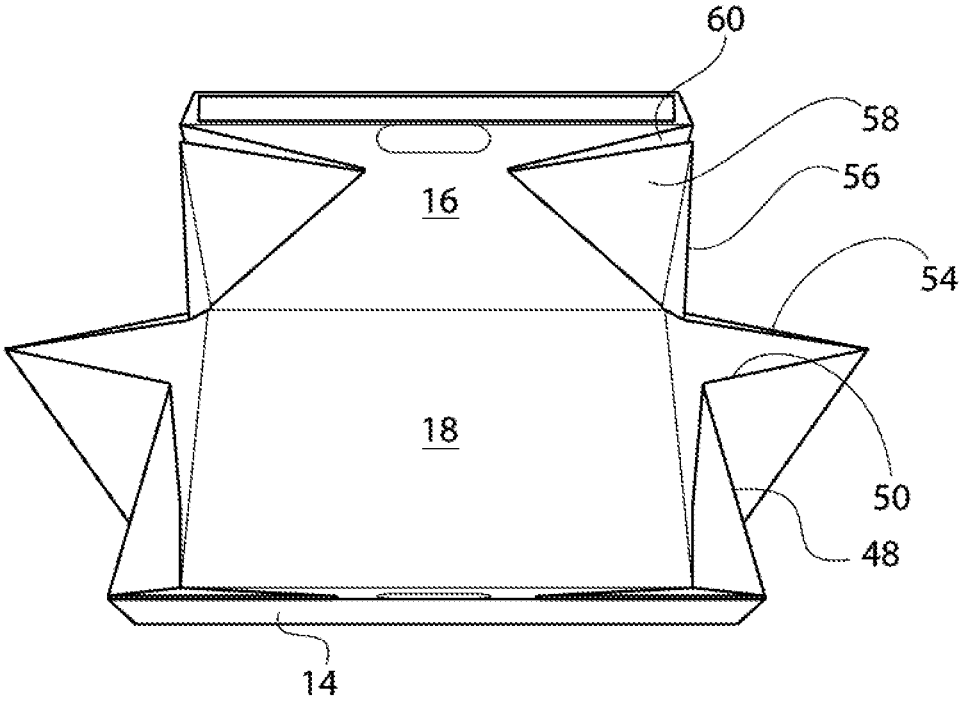
FIG. 7 shows a top perspective view of one embodiment of a cooler carrier as the inwardly foldable panels are folded more tightly inward.

The next two panels form a second set of inwardly foldable panels 54, 56. The third inwardly foldable panel 54 can be folded against the fourth inwardly foldable panel 56, as shown in Figures and 8. When the carrier 10 is in the closed configuration, the second inwardly foldable panel 50 and the third inwardly foldable panel 54 abut one another. The final set of panels is a second set of glue flap panels 58, 60 formed as the right-most panels. The fourth glue flap panel 60 can be glued to the back wall panel 16. The third glue flap panel 58 can be glued to the fourth glue flap panel 60. A partially assembled figure of the carrier showing glue flaps 44, 46, 58, 60 secured to one another and the front and back panels is shown in FIG. 5. The nine panels that form the gusseted side portions 20 are generally separated from one another via pre-formed crease lines 26, which allow easy assembly of the carrier 10 once it has been loaded with product. The panels may also have one or more perforated portions along the crease lines 26 that ease folding. A perforated edge 66 may also be provided along one of the front or back wall panels 14, 16 or both, in order to ease opening of the carrier 10.

Figure 9:
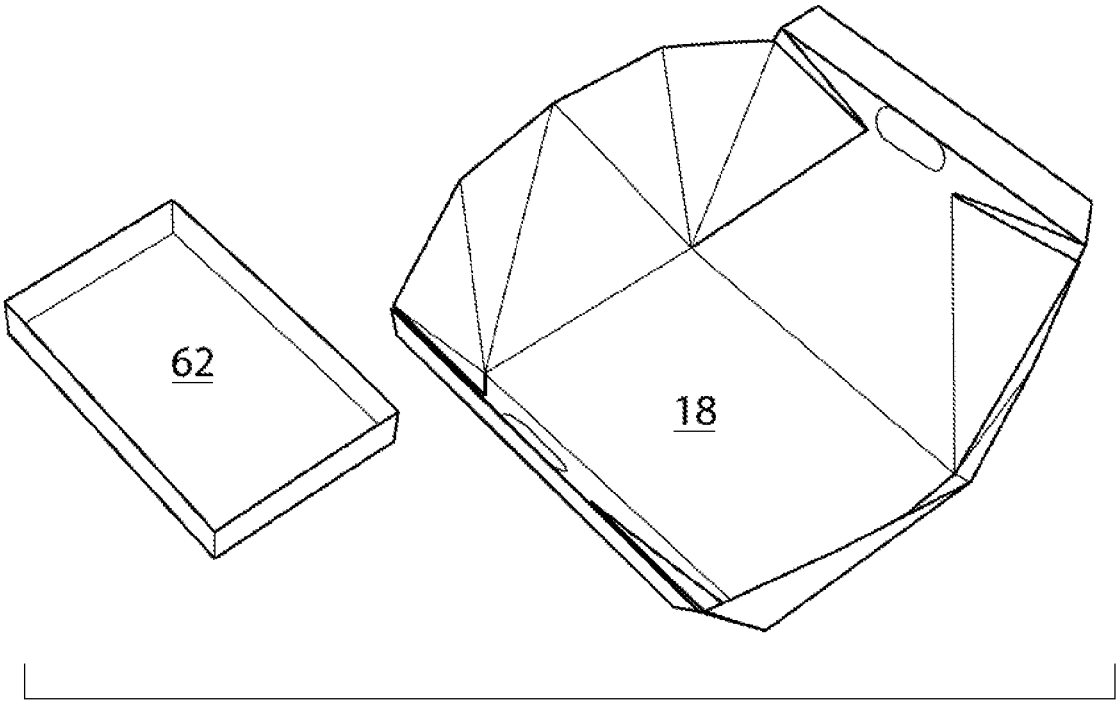
FIG. 9 shows a perspective view of how a cooler carrier may be prepared for packaging.
Figure 10:
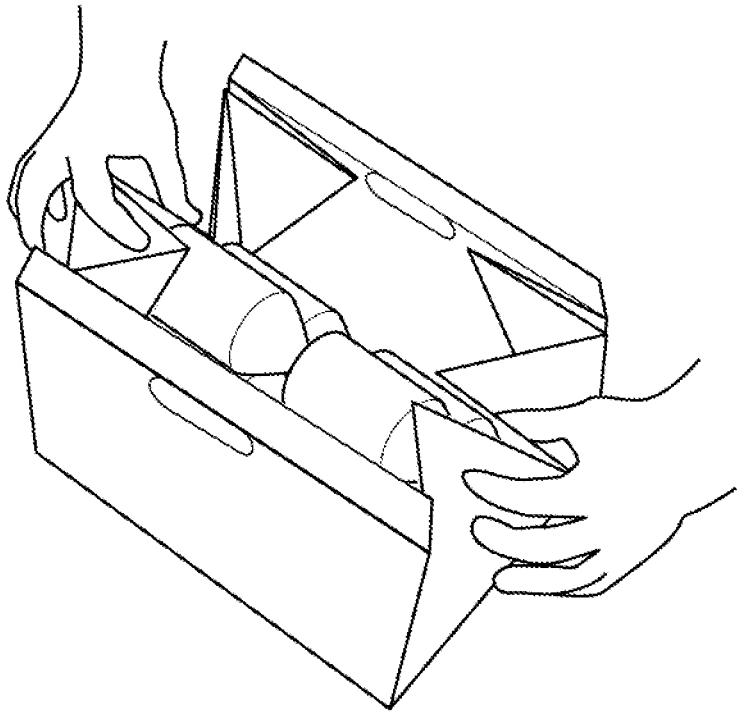
FIG. 10 shows a perspective view of a cooler carrier being loaded with containers and having the inwardly foldable panels folded inwardly.

Assembly of the carrier is shown in FIGS. 4-10. First, the blank 24 may be printed with the desired colors and graphics, die-cut, and pre-folded along the desired pre-formed crease lines 26. These steps may occur in any desired order. The front and back wall panels 14,16 are folded up and away from the base panel 18. The glue flaps 44, 46 and 58, 60 of the gusseted side portions 20 may be folded and panels 44 and 46 glued to one another, panels 58 and 60 glues to one another, and then the left-most panel 44 and the right-most panel 60 may be glued to the front and back wall panels 14, 16, respectively. This provides a basic shape of the carrier as it will be provided in the open position. One example of this is shown in FIG. 4. An inner tray 62 may then be placed against the base panel 18. One embodiment of an inner tray 62 shown in position against the base panel 18 is illustrated by FIG. 5. The inner tray 62 is provided to hold and support beverages or other items to be contained within carrier 10. For example, in one embodiment, beverage bottles may be laid end-to-end in the inner tray 62 and stacked in a pyramidal shape so that the folding of the carrier over the beverage bottles can be accomplished. Examples are shown in FIGS. 9 and 10.

Once the carrier 10 has been loaded, the gusseted side portions 20 may be folded inwardly. In a specific embodiment, the inwardly foldable panels 48, 50 are folded inwardly and inwardly foldable panels 54, 56 are folded inwardly. The two sets of inwardly foldable panels abut one another, as shown in FIG. 10. This folding causes the middle face panel 52 to form the side of the carrier 10 and to be the only side panel that is viewable when the carrier 10 is closed. Once the gusseted side portions 20 are folded such that the middle face panel 52 will be the only panel visible from the side, the front and back wall panels 14, 16 are secured to one another in order to effect securement of the carrier 10 in a closed position.

In one embodiment, the front and back wall panels 14, 16 may be secured to one another via a double-faced or double-sided tape 34. In another embodiment, they may be glued to one another, heat sealed to one another, or secured via any other appropriate method. The general concept is that bringing together of the front and back wall panels 14, 16 creates a pyramid-like shape for the carrier 10 (or a triangular shape from the side view). Once the panels 14, 16 are secured to one another, the handle/carrying opening 42 can be formed by pressing the curved cut-out portions 38 of each panel 14, 16 (which now abut one another) to one side.

Figure 11:
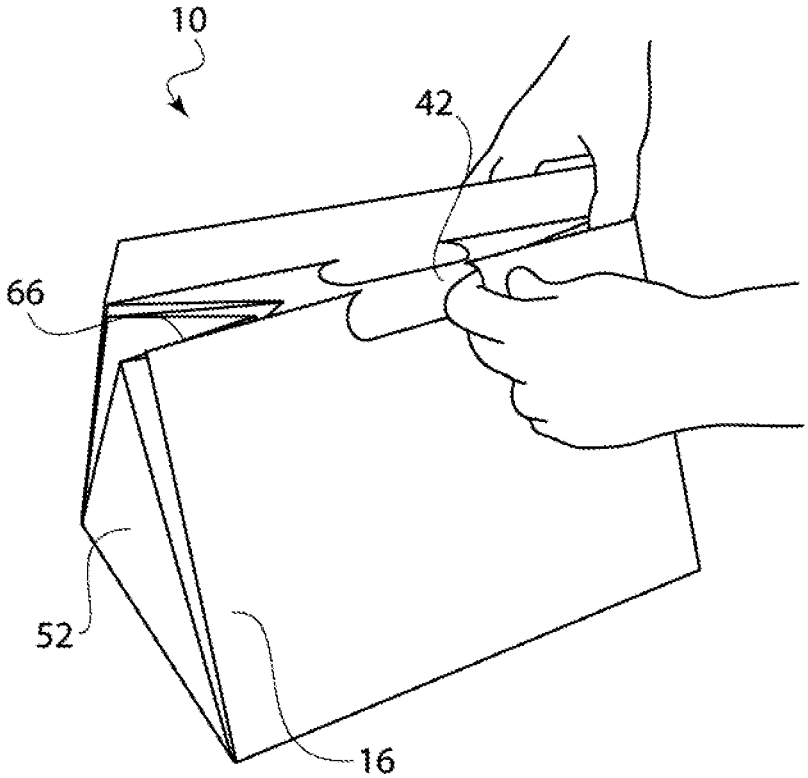
FIG. 11 shows a side perspective view of a cooler carrier being opened along a perforated edge. Once expanded, the cooler carrier of FIG. 11 will generally resemble the configuration of FIG. 2.

Once the carrier 10 has been delivered to its desired location and is ready for opening, a user may tear along the perforated edge 66, as shown in FIG. 11. Perforated edge 66 is shown as being located on the back wall panel 16 in FIG. 3, but it should be understood that it may be positioned on the front wall panel 14, or other than at the top of one of these panels. One benefit of positioning the perforated edge 66 near the upper edge 30 of one of these panels is that the graphics on the entire panel are not destroyed upon opening, and the integrity of the interior space 22 can be maintained for use of the carrier 10 as a cooler, as shown in FIG. 2.

For example, in some embodiments, the carrier blank 24 may have promotional or other graphics printed thereon so that the carrier 10 also serves as a promotional cooler. In one specific example, the graphic on middle face panel 52 may be designed so that it meets up visually with the graphics at the edge of the front and back wall panels 14, 16. However, the graphics on the remainder of the gusseted side wall 20 panels that are viewable when the carrier 10 is opened may also be designed to visually flow with the middle panel 52, as well as the front and back wall panels 14, 16. In one specific embodiment, the graphics can depict a cold scene, such as mountains or snow. Once opened, the design may be such that the carrier looks like an avalanche occurred and the consumer can add ice so the carrier serves as a cooler. In another specific embodiment, the graphics can depict a warm scene, such as a beach or pool.

The design can be carried as a "purse" in some embodiments. In one aspect, larger handle-shaped openings may be provided than those shown in the figures.

It is also possible to provide the carrier with an internal coating to render the carrier resistant to leakage when containing ice. For example, the internal coating may be a laminated layer, a chemical treatment, or any other coating. It is also possible to package the carrier with an internal plastic bag so that the bag can be laid in the interior of the carrier once opened and contain any ice that may be added.

Changes and modifications, additions and deletions may be made to the structures and methods recited above and shown in the drawings without departing from the scope or spirit of the invention and the following claims. For example, although the carrier is shown as forming a generally pyramid-like shape in the closed position, one or more additional panels may be added to create a more traditional box-shaped container/carrier. Although nine panels are shown to form the gusseted side portions, it should be understood that fewer or more panels may be used. It has been found that the panels fold inwardly in a particularly desirable way when the panels are formed as having a triangular shape. However, it is possible for the side panels to have varied shapes. Other modifications that re within the scope of the following claims may be possible.

What is claimed is:

1. A carrier, comprising:

a. a body portion having a base panel and front and back wall panels;

b. an upper handle portion;

c. two gusseted side portions, each comprising a plurality of foldable panels that are configured to fold inwardly when the carrier is in a closed position and to slant hingedly outwardly from the base panel at an angle greater than 90 degrees when the carrier is in an opened position.

2. The carrier of claim 1, wherein the front and back wall panels are inwardly sloped when the carrier is in a closed position to form a carrier having a pyramid-like shape.

3. The carrier of claim 2, wherein the inwardly sloped front and back walls each comprise a base-contacting edge and an upper edge with a handle shaped opening near the upper edge, such that when the front and back walls are drawn toward one another, the handle shaped openings meet to form a handle opening.

4. The carrier of claim 1, wherein each gusseted side portion comprises a series of nine consecutive panels, with first and ninth panels that are foldably connected to the front and back wall panels respectively and glued thereto in use.

5. The carrier of claim 1, wherein each gusseted side portion comprises a middle face panel that is visible when the carrier is closed, and a series of left and right panels foldably connected to the middle face panel that fold inwardly and are not visible when the carrier is closed.

6. The carrier of claim 1, wherein the carrier is configured to contain and carry a plurality of containers, and when opened, to further contain ice.

7. The carrier of claim 1, wherein the carrier has an internal coating to render the carrier resistant to leakage when containing ice.

8. The carrier of claim 1, wherein the gusseted side walls have printing thereon.

9. The carrier of claim 1, further comprising an inner tray configured to rest against the base panel in order to support beverages.

10. The carrier of claim 1, wherein the carrier has a generally pyramidal shape in the closed position, and a generally wide-mouthed open shape in the open position.

11. A carrier, comprising:

a body portion having a base panel and front and back wall panels;

an upper handle portion;

two gusseted side portions, each comprising a plurality of foldable panels that are configured to fold inwardly when the carrier is in a closed position and to expand hingedly outwardly from the base panel when the carrier is in an opened position, wherein each gusseted side portion comprises:

a. two left glue flap panels, b. two left inwardly foldable panels, c. a middle face panel, d. two right inwardly foldable panels, and e. two right glue flap panels.

12. The carrier of claim 11, wherein the two left glue flap panels are secured to the front wall panel.

13. A method for containing beverages in a cooler carrier and for maintaining a cooled temperature of the beverages upon use of the cooler carrier, comprising:

a. providing the cooler carrier of claim 1, the cooler carrier containing a series of beverages sealed inside the cooler carrier, the cooler carrier comprising gusseted side walls comprising a middle face panel and inwardly folded side walls;

b. opening the cooler carrier along a perforated edge;

c. expanding the inwardly folded side walls outwardly such that they slant from the base panel at an angle greater than 90 degrees;

d. filling the cooler carrier with ice to keep the beverages chilled.

14. A carrier, comprising:

a. a body portion having a base panel and front and back wall panels;

b. an upper handle portion;

c. two gusseted side portions, each comprising a plurality of foldable panels that are configured to fold inwardly when the carrier is in a closed position and to slant open and expand away from the base panel when the carrier is in an opened position, wherein each gusseted side portion comprises: two left glue flap panels, two left inwardly foldable panels, a middle face panel, two right inwardly foldable panels, and two right glue flap panels.

15. The carrier of claim 14, wherein the two left glue flap panels are secured to the front wall panel.

16. A carrier, comprising:

a. a body portion having a base panel and front and back wall panels;

b. an upper handle portion;

c. two gusseted side portions, each comprising a plurality of foldable panels that are configured to fold inwardly when the carrier is in a closed position and to slant from the base panel at an angle greater than 90 degrees when the carrier is in an opened position, wherein each gusseted side portion comprises a series of nine consecutive panels, with first and ninth panels that are foldably connected to the front and back wall panels respectively and glued thereto in use.

17. A carrier, comprising:

a body portion having a base panel, a front wall panel, and a back wall panel, each of the front and back wall panels comprising a base-contacting edge and a handle portion, first and second gusseted side portions, each of the first and second gusseted side portions comprising a plurality of foldable panels that are configured to fold inwardly when the carrier is in a closed position and to slant open and expand away from the base panel at an angle greater than 90 degrees when the carrier is in an open position wherein bringing together of the front wall panel and the back wall panel such that the handle portions meet creates a pyramid shape for the carrier when closed.

18. The carrier of claim 17, wherein each gusseted side portion comprises two left glue flap panels, two left inwardly foldable panels, a middle face panel, two right inwardly foldable panels, and two right glue flap panels.

* * * * *